US006398508B1

(12) United States Patent
Yang

(10) Patent No.: US 6,398,508 B1
(45) Date of Patent: Jun. 4, 2002

(54) CONTROL SWITCH ASSEMBLY FOR AN AIR PUMP

(76) Inventor: Hsi-Kung Yang, No. 24, Lane 65, San Chun St., Shu Lin Chen, Taipei Hsien (TW)

( * ) Notice: Subject to any disclaimer, the term of this patent is extended or adjusted under 35 U.S.C. 154(b) by 0 days.

(21) Appl. No.: 09/749,322

(22) Filed: Dec. 27, 2000

(51) Int. Cl.[7] ..... F04B 49/00; F04B 39/00; F04B 23/00; F04B 53/00; F04B 41/00

(52) U.S. Cl. ..... 417/33; 417/435; 417/440

(58) Field of Search ..... 417/33, 435, 434, 417/440; 251/321

(56) References Cited

U.S. PATENT DOCUMENTS 3,283,094 A * 11/1966 Lung ..... 200/81 R
4,037,994 A * 7/1977 Bird ..... 200/61.86
4,080,105 A * 3/1978 Connell ..... 137/224
4,614,479 A * 9/1986 Liu ..... 137/224
5,125,800 A * 6/1992 Wong ..... 417/26
5,352,096 A * 10/1994 Chi-Wen ..... 417/12

* cited by examiner

*Primary Examiner*—Charles G. Freay
*Assistant Examiner*—Timothy P. Solak
(74) *Attorney, Agent, or Firm*—Alan Kamrath; Rider, Bennett, Egan & Arundel, LLP

(57) ABSTRACT

A control switch assembly for an air pump has a unidirectional valve mounted inside a port that is mounted together with a contact device on an actuation device. The actuation device has an extension slidably received in the actuation device and controllably connected to a knob. With the movement of the extension, a switch inside the contact device is able to selectively make an electrical connection and an actuating pin of the unidirectional valve is able to selectively open an airway inside the port. When the electrical connection of the switch is disconnected and the airway is opened by the movement of the actuating pin, the pressure above a diaphragm and inside the compressor is able to be released from the airway of the port so as to smooth the actuation of the compressor.

8 Claims, 4 Drawing Sheets

CONTROL SWITCH ASSEMBLY FOR AN AIR PUMP

BACKGROUND OF THE INVENTION

1. Field of the Invention

The present invention relates to a control switch assembly for an air pump, and more particularly to a control switch assembly having a unidirectional valve actuatably mounted on a nozzle that is securely attached to the control switch assembly. When the control switch is deactivated, the unidirectional valve is actuated by a push rod controllably connected to the control switch. The pressure inside a diaphragm of the air pump will bleed off before the air pump starts to work to facilitate air being pumped into an object.

2. Description of Related Art

A conventional air pump has a diaphragm inside the air pump, so that with the vibration of the diaphragm, the air is pumped outside the pump. However, there is a problem concerning the diaphragm. When the compressor stops, pressure exists in the space above the diaphragm, and the pressure will apply a force on the diaphragm to stop the diaphragm from vibrating. Under such a condition, even with the mechanical assistance of a cam in the compressor, the diaphragm will not vibrate. It is noted that if the diaphragm is not able to vibrate, the air from the inlet will not be able to be pumped outside the compressor from the exhaust port. With reference to FIG. 5, a conventional air pump has a compressor (70) with two discharge ports (71, 72) with each port (71, 72) connected to a tube. One of the tubes is connected to an outlet nozzle (73) to inject air into an object, e.g. a tire, and the other tube is connected to a pressure gauge (74) so that a user is able to sense the pressure inside the object. A switch (75) controls the activation of the compressor (70), such that when the switch (75) is actuated (pressed), the compressor (70) starts and air is pumped and ejected from the compressor (70) through the outlet nozzle (73). From practical experience, persons skilled in the art know that a compressor (70) has to start before attempting to inflate an object. That is, the compressor (70) has to begin pumping air before any attempt is made to inflate the object. Otherwise, the diaphragm inside the compressor (70) will be under a pressure greater than what the compressor can handle. When the pressure exists above the diaphragm, it is impossible for the compressor to work with the current design.

In order to overcome the foregoing problems, the invention intends to provide an improved control switch assembly for an air pump to mitigate and obviate the problems existing in the current design.

SUMMARY OF THE INVENTION

The primary objective of the invention is to provide an improved control switch assembly with a unidirectional valve selectively activated by the movement of the control knob. With such an arrangement, when the control knob deactivates the compressor, the unidirectional valve allows the pressure above the diaphragm to bleed out of the compressor to facilitate the pumping of air into the object.

Another objective of the invention is to provide a second unidirectional valve in the exhaust port to ensure that the air inside the object will not flow back into the compressor to hinder the operation of the compressor and thus to smooth the outflow of air pumped by the compressor.

Other objects, advantages and novel features of the invention will become more apparent from the following detailed description when taken in conjunction with the accompanying drawings.

DETAILED DESCRIPTION OF PREFERRED EMBODIMENT

Figure 1:
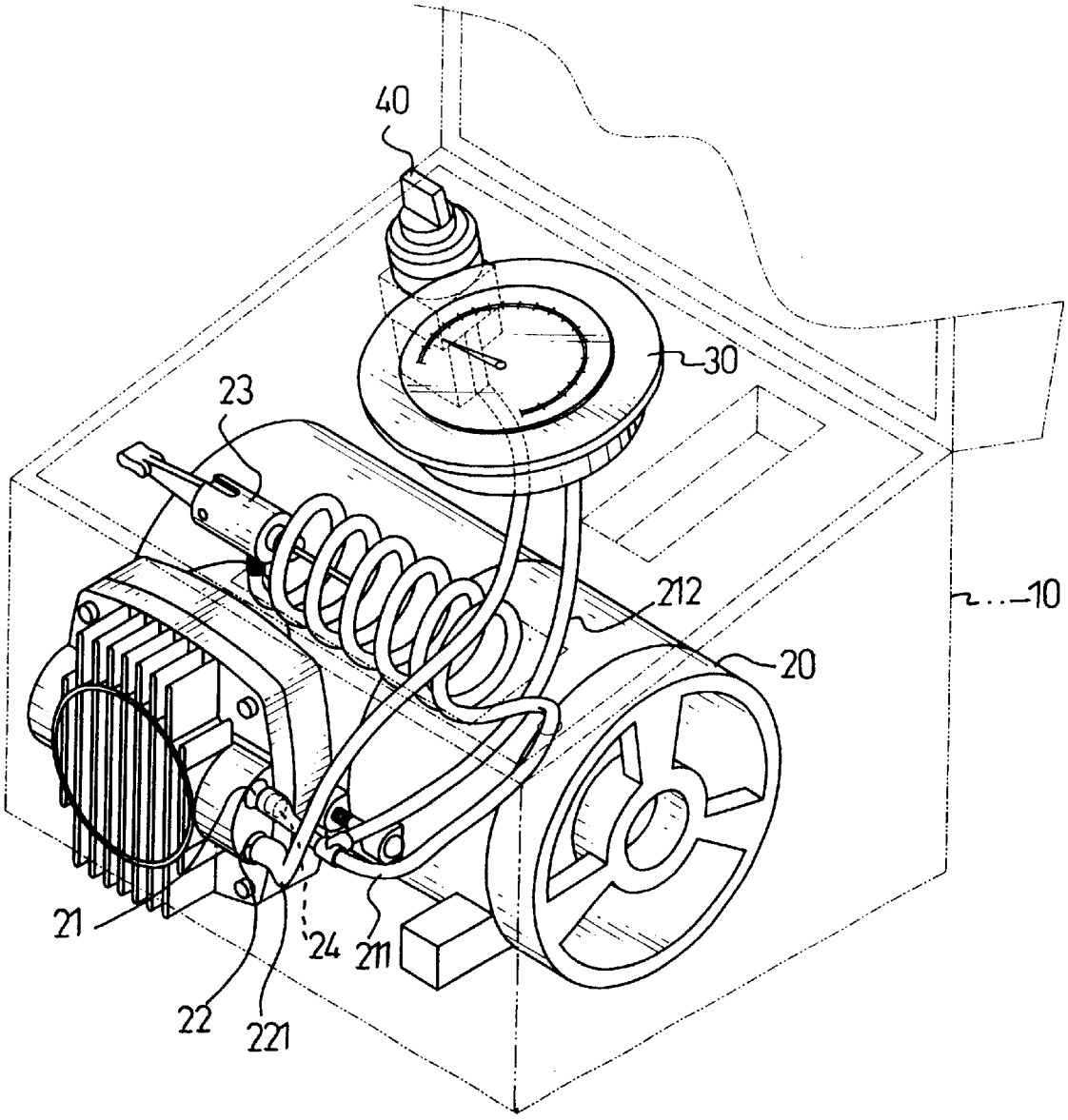
FIG. 1 is a perspective view of a control switch assembly in accordance with the present invention used with an air pump.

With reference to FIG. 1, an air pump has a casing (10), a compressor (20), a pressure gauge (30) and a control switch assembly (40) in accordance with the present invention.

The casing (10) defines a space to hold and mount the compressor (20). The compressor (20) has a first discharge port (21) connected to a nozzle (23) by a first tube (211) and a second discharge port (22) connected to the control switch assembly (40) by means of a second tube (221). The first tube (211) has an auxiliary tube (212) connected to the pressure gauge (30) so that the user is able to sense the pressure inside an object that is being inflated.

Figure 2:
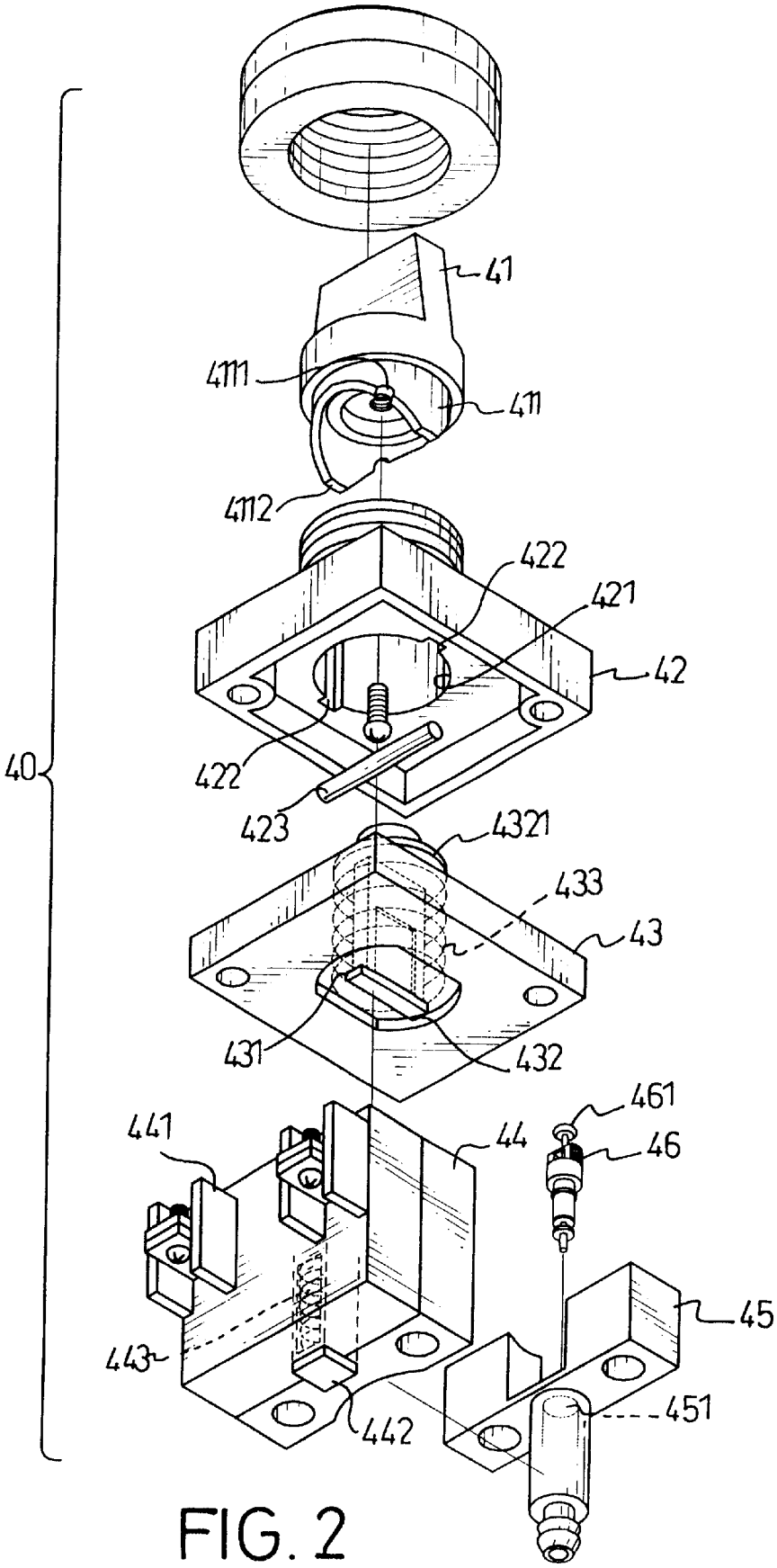
FIG. 2 is an exploded perspective view of the control switch assembly in FIG. 1.

The following description refers to FIG. 2. To obviate the aforementioned problem, the control switch assembly (40) in accordance with the present invention has a knob (41), a body (42), an actuation device (43), a contact device (44), a port (45) and a first unidirectional valve (46). The knob (41) has a saddle like protrusion (411) integrally extending out from a bottom of the knob (41). The saddle like protrusion (411) has a first detent (4111) and a second detent (4112). The body (42) has a channel (421) defined to rotatably and partially receive the knob (41). The channel (421) has two opposed longitudinal grooves (422) in a periphery defining the channel (421) and a bar (423) slidably received in the longitudinal grooves (422) and abutting the saddle like protrusion (411).

The actuation device (43) has a centrally defined through hole (431), an extension (432) slidably mounted in the through hole (431) and having a flange (4321) integrally formed with the extension (432) and a coil spring (433) mounted around the extension (432). One end of the coil spring (433) abuts a bottom defining the through hole (431), and the other end abuts the flange (4321) such that a recovery force is provided to the extension (432) when required One end of the extension (432) engages the bar (423).

The contact device (44) has a switch (441) controllably connected to the extension (432) and a rod (442) slidably received within the switch (441) and provided with a spring (443) to provide the rod (442) a recovery force. The rod (442) engages with the free end of the extension (432) so that the rod (442) moves with the extension (432).

The port (45) has an airway (451) defined to receive the unidirectional valve (46) The unidirectional valve (46) has an actuating pin (461) compressibly received in the airway (451) and selectively abutting the free end of the extension (432).

Figure 4:
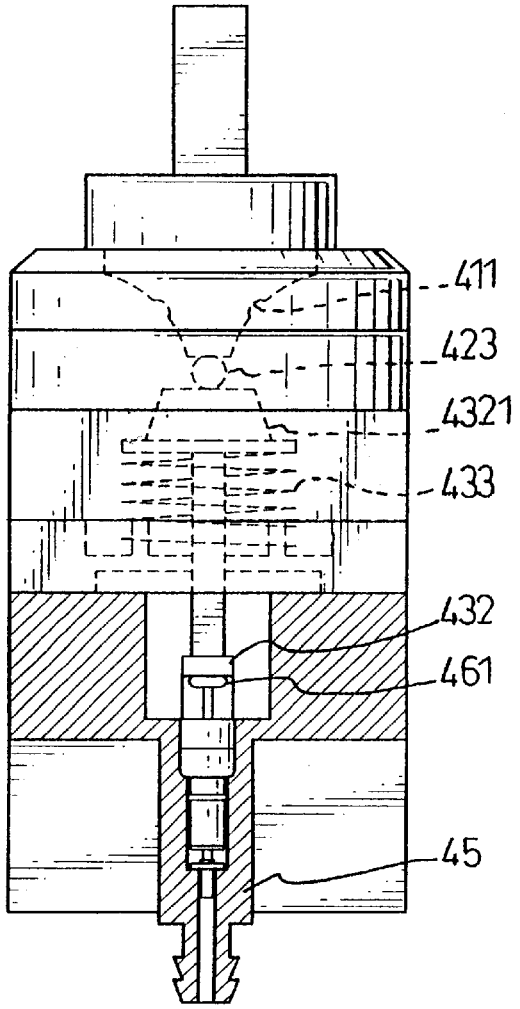
FIG. 4 is an operational side of view in partial section of the control switch assembly with the unidirectional valve activated by the control knob.
Figure 3:
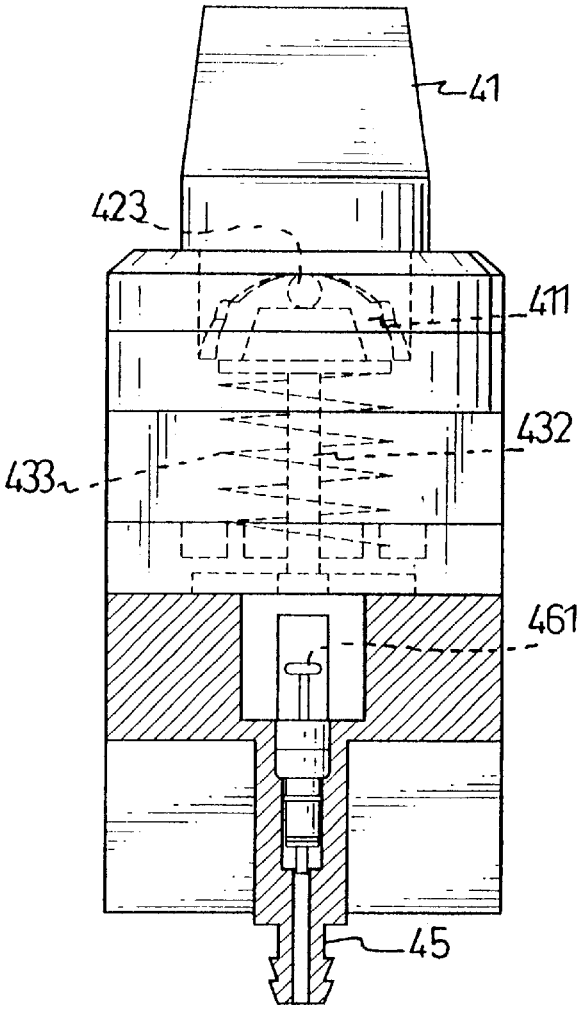
FIG. 3 is an operational side plan view in partial section of the control switch assembly in FIG. 1 with the unidirectional valve not activated.
Figure 5:
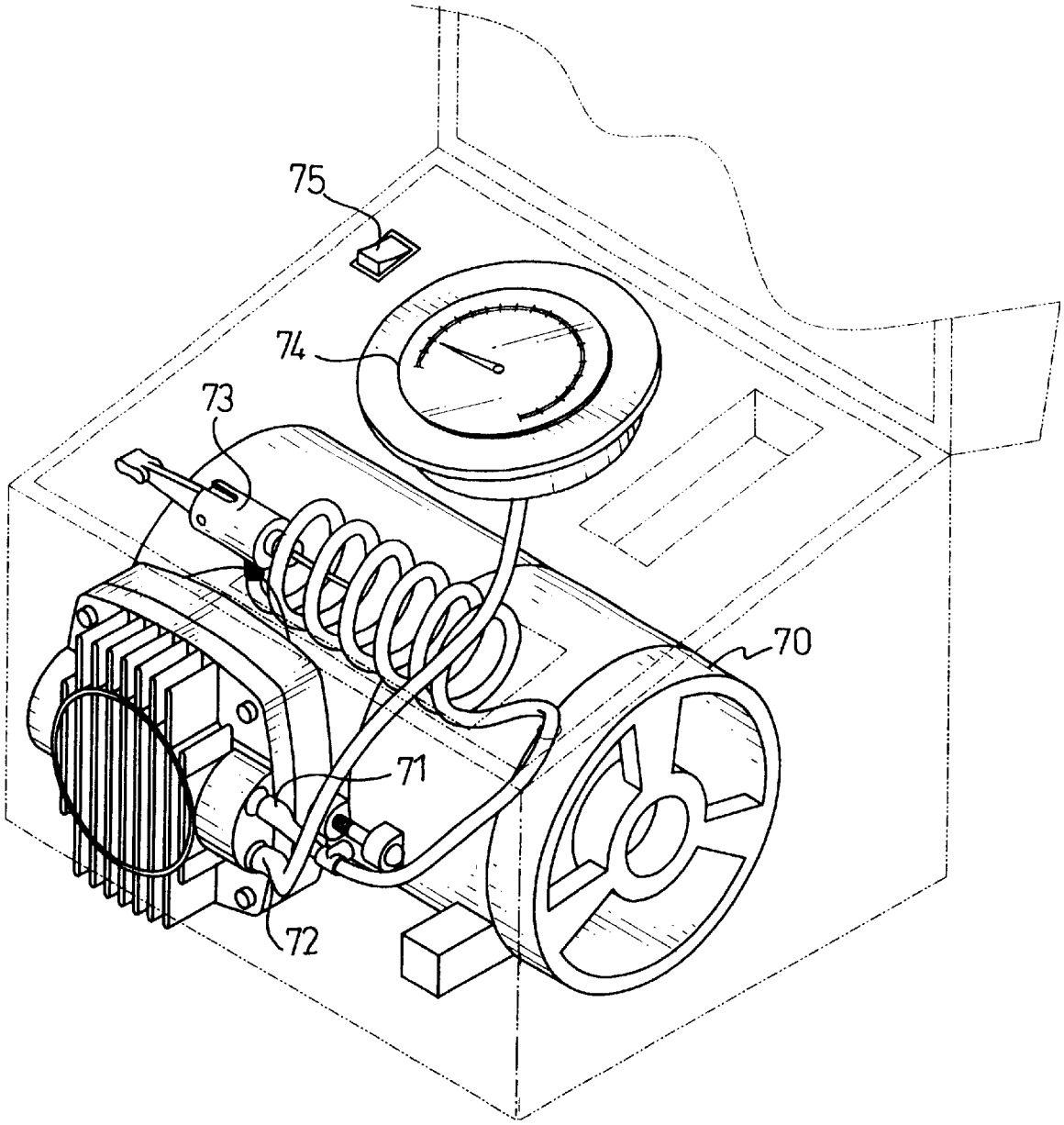
FIG. 5 PRIOR ART
FIG. 5 is a perspective view of a conventional air pump.

With reference to FIGS. 2, 3 and 4, the knob (41) is partially received in the channel (421) and the bar (423) is received in the longitudinal grooves (422). The actuation device (43) is securely engaged with the body (42) to have one end of the extension (432) received in the channel (421), such that the rotation of the knob (41) causes the bar (423) to move in the longitudinal grooves (422) along the edge of the saddle like protrusion (411). Because the saddle like protrusion (411) extends into the channel (421), the rotation of the saddle like protrusion (411) will thus cause the bar (423) to move along opposite edges of the protrusion (411). When the bar (423) moves along the opposite edges of the saddle like protrusion (411), the bar (423) rests respectively in the first detent (4111) and the second detent (4112). As the bar (423) moves along the edges of the saddle like protrusion (411), the bar (423) gradually abuts one end of the extension (432) and pushes the extension (432) out from the through hole (431) the end of the extension (432) protruding from the through hole (431) abuts one end of the rod (442) and the actuating pin (461). The movement of the rod (442) will thus activate the electrical connection in the switch (441).

With reference to FIGS. 4 and 2, when the knob (41) rotates, the saddle like protrusion (411) drives the bar (423) along opposite edges of the saddle like protrusion (411). When the bar (423) rests in the second detent (4112) due to the abutment of the coil spring (433), the movement of the bar (423) will thus drive the extension (432) to move and press the rod (442). When the extension (432) presses the rod (442), the electrical connection in the switch (441) is activated. When the extension (432) presses the actuating pin (461), the airway (451) is blocked by the unidirectional valve (46).

If the knob (41) rotates backward trying to disconnect the electrical connection in the switch (441), the bar (423) moves from the second detent (4112) to the first detent (4111) and finally to the bottom of the saddle like protrusion (411), which allows the extension (432) to move backward in the through hole (431) and thereby release the abutment to the rod (442). When the extension (432) retracts, the abutment to the actuating pin (461) is also released, which allows the actuating pin (461) to open the airway (451).

With reference to FIGS. 3 find 4 and again taking FIG. 1 for reference, when the control switch assembly is used with an air pump, the rotation of the knob (41) blocks the airway (451) of the port (45) and thus the pumped air is pumped into an object. When the user wants to check the pressure inside the object the user rotates the knob (41) to stop the compressor (20). At the moment the compressor (20) stops, the retraction of the extension (432) causes the backward movement of the rod (442) to disconnect the electrical connection in the switch (441) and the extension of the actuating pin (461) to open the airway (451). While the airway (451) is opened, the pressure inside the compressor (20) and above the diaphragm is able to bleed offthrough the second tube (221), the airway (451) and the unidirectional valve (46) to cause the pressure above the diaphragm to become 0 psi. Thereafter, when the compressor (20) is once again started, because the pressure above the diaphragm is reduced to 0 psi, it is very easy for the pumped air to be pumped outside the compressor (20) by means of the nozzle (23).

With reference to FIG. 1, to ensure that the air is smoothly pumped outside the compressor (20) during the inflation process, a second unidirectional valve (24) is mounted inside the first discharge port (21) such that there is only one way for the air to pass through the first discharge port (21). A worry that the pressure might feed backward into the compressor (20) is solved.

From the foregoing description, it is noted that with the help of the control switch assembly of the invention, the problem of having the pressure preventing the starting of the compressor is easily solved. Because the unidirectional valve (46), the port (45), the switch (441) and the knob (41) are all quite simple in structure and there is no need to modify the present air pump to connect and mount the control switch assembly, the control switch assembly is cost effective.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A control switch assembly for an air pump for bleeding off pressure above the diaphragm, the air pump having a compressor provided with a first discharge port connected to a nozzle and a second discharge port connected to the control switch assembly by a tube, the control switch assembly comprising:

a knob having a saddle like protrusion integrally extending out from a bottom of the knob;

a body defining a channel to pivotally and partially receive the knob and having two opposed longitudinal grooves in a periphery defining the channel and a bar slidably received in the longitudinal grooves and abutting the saddle like protrusion;

an actuation device securely engaged with the body and having a centrally defined through hole, an extension slidably received in the through hole to selectively pressed by the bar and having a coil spring mounted around the extension to provide a recovery force to the extension when required;

a contact device firmly engaged with the actuation device and having a switch to selective make an electrical connection by the movement of the extension with the switch having a rod slidably received within the switch to selectively be pressed by the extension and provided with a spring around the rod to provide the rod a recovery force; and a port firmly engaged with the actuation device and having an airway defined to receive a unidirectional valve with an actuating pin compressibly received inside the unidirectional valve and being selectively pressed by a tree end of the extension.

2. The control switch assembly as claimed in claim 1, wherein the extension has a flange integrally formed with the extension such that the coil spring is compressibly received between the flange and a face declining the through hole.

3. The control switch assembly as claimed in claim 2, wherein the saddle like protrusion has a first detent and a second detent defined along an edge of the saddle like protrusion so as to allow the bar to rest in the detent selected.

4. The control switch assembly as claimed in claim 3, wherein a second unidirectional valve is adapted to be received in the first discharge port of the compressor to ensure that pressure will not feed back from an object to the compressor.

5. The control switch assembly as claimed in claim 2, wherein a second unidirectional valve is adapted to be received in the first discharge port of the compressor to ensure that pressure will not feed back from an object to the compressor.

6. The control switch assembly as claimed in claim 1 wherein the saddle like protrusion has a first detent and a second detent defined along an edge of the saddle like protrusion so as to allow the bar to rest in the detent selected.

7. The control switch assembly as claimed in claim 6, wherein a second unidirectional valve is adapted to be received in the first discharge port of the compressor to ensure that pressure will not feed back from an object to the compressor.

8. The control switch assembly as claimed in claim 1, wherein a second unidirectional valve is adapted to be received in the first discharge port of the compressor to ensure that pressure will not feed back from an object to the compressor.

* * * * *